US007581259B2

(12) United States Patent
Thompson

(10) Patent No.: US 7,581,259 B2
(45) Date of Patent: Sep. 1, 2009

(54) CHAIR BLANKET, AND METHOD FOR COVERING CHAIR OCCUPANT

(76) Inventor: Joe Thompson, 980 Fox Ridge La., Caryville, TN (US) 37714

( * ) Notice: Subject to any disclaimer, the term of this patent is extended or adjusted under 35 U.S.C. 154(b) by 436 days.

(21) Appl. No.: 11/165,152

(22) Filed: Jun. 23, 2005

(65) Prior Publication Data

US 2007/0007800 A1 Jan. 11, 2007

(51) Int. Cl.
*A41B 13/06* (2006.01)

(52) U.S. Cl. ..... 2/69.5

(58) Field of Classification Search ..... 2/69.5, 2/86, 89, 114, 83, 92; 5/482, 485, 636
See application file for complete search history.

(56) References Cited

U.S. PATENT DOCUMENTS

| | | | | | |
|---|---|---|---|---|---|
| 569,521 | A | | 10/1896 | Scatchard | |
| 751,452 | A | * | 2/1904 | Bird | 296/81 |
| 1,225,966 | A | * | 5/1917 | Jones | 2/114 |
| 1,538,538 | A | * | 5/1925 | Wood | 297/229 |
| 1,614,126 | A | * | 1/1927 | Hart | 2/48 |
| 2,652,183 | A | * | 9/1953 | Hlivka | 297/229 |
| 2,659,086 | A | * | 11/1953 | McGrath | 2/88 |
| 2,680,849 | A | * | 6/1954 | Munro | 2/69.5 |
| 2,705,325 | A | * | 4/1955 | Bogenberger | 2/69 |
| 2,707,988 | A | * | 5/1955 | Shaub et al. | 297/255 |
| 2,712,133 | A | * | 7/1955 | Coleman | 2/69 |
| 2,716,239 | A | | 8/1955 | Bamdollar | |
| 3,443,066 | A | * | 5/1969 | Weibel | 219/527 |
| 3,597,764 | A | * | 8/1971 | Povey | 2/69.5 |
| 3,669,107 | A | * | 6/1972 | Posey | 128/870 |
| 3,812,539 | A | * | 5/1974 | Muehlberg et al. | 2/69.5 |
| 3,965,487 | A | * | 6/1976 | Mazur | 2/69.5 |
| 4,241,458 | A | * | 12/1980 | Lesesne | 2/69.5 |
| 4,363,141 | A | | 12/1982 | Doster | |
| 4,534,065 | A | | 8/1985 | Comfort | |
| 4,611,353 | A | | 9/1986 | Als et al. | |
| 4,651,346 | A | | 3/1987 | Hale | |
| 4,676,376 | A | * | 6/1987 | Keiswetter | 206/494 |
| 4,826,242 | A | | 5/1989 | Trethewey | |
| 4,846,528 | A | * | 7/1989 | Beier | 297/465 |
| 4,932,077 | A | | 6/1990 | Dobbs | |
| 4,993,090 | A | * | 2/1991 | Ranalli | 5/482 |
| 5,131,096 | A | * | 7/1992 | Olson | 2/75 |
| 5,168,579 | A | * | 12/1992 | Marshall | 2/88 |
| 5,283,909 | A | | 2/1994 | Hill | |

(Continued)

*Primary Examiner*—Alissa L Hoey
(74) *Attorney, Agent, or Firm*—Peter L. Brewer; Baker Bonelson Bearman Caldwell & Berkowitz, PC

(57) ABSTRACT

A blanket for a chair occupant, the chair having a seat and a back. The blanket includes an upper end, a lower end, opposing sides, an outer surface to be placed onto the seat of the chair, an inner surface on which the occupant sits, and a connector for connecting the opposing sides over the occupant when the occupant is seated onto the inner surface of the blanket. Preferably, an attachment device is provided for releasably securing the blanket to the chair before the occupant is seated. A method for covering a wheelchair occupant is also provided, having the steps of providing the blanket, placing the blanket over the seat of a wheelchair, attaching a flap on the upper end of the blanket to the wheelchair to keep the blanket from shifting, seating the occupant onto the blanket in the wheelchair, folding the opposing sides of the blanket over the occupant, and zipping the opposing sides together.

18 Claims, 3 Drawing Sheets

U.S. PATENT DOCUMENTS 5,437,061 A * 8/1995 Kenner ..... 2/69
5,560,043 A * 10/1996 Armstrong ..... 2/69.5
5,561,859 A * 10/1996 Fischer ..... 2/69.5
5,604,932 A 2/1997 Lawicki
5,626,397 A * 5/1997 Reid ..... 297/467
5,727,255 A * 3/1998 Minks ..... 2/69
5,950,261 A * 9/1999 Hay et al. ..... 5/482
5,956,766 A * 9/1999 Benway ..... 2/69
5,970,542 A 10/1999 Mays
6,012,189 A * 1/2000 Dudley ..... 5/655
D420,780 S 2/2000 Cox et al.
6,055,686 A * 5/2000 Knight ..... 5/494
D430,079 S * 8/2000 Catron-Batts ..... D12/133
6,105,168 A * 8/2000 Hazen ..... 2/69.5
D434,205 S * 11/2000 Kapszukiewicz ..... D2/860
6,145,932 A * 11/2000 Hamel-Nyhus et al. ..... 297/465
6,334,221 B1 * 1/2002 Hope ..... 2/69.5
6,394,543 B1 * 5/2002 Dunne et al. ..... 297/219.12
6,643,870 B2 11/2003 Bertrand
6,675,414 B2 1/2004 Lamke
6,764,134 B1 * 7/2004 Crescenzi et al. ..... 297/219.12
6,769,135 B1 * 8/2004 Monroe ..... 2/50
6,851,127 B1 2/2005 Khan
7,036,153 B2 * 5/2006 Gibson et al. ..... 2/69
D560,948 S * 2/2008 Bertrand ..... D6/603
2003/0079270 A1 * 5/2003 Bailey ..... 2/69.5
2005/0262613 A1 * 12/2005 Panek ..... 2/89
2006/0117455 A1 * 6/2006 Park et al. ..... 2/69.5
2006/0200906 A1 * 9/2006 Deering et al. ..... 5/482
2007/0061965 A1 * 3/2007 Crawford ..... 5/413 R

* cited by examiner

CHAIR BLANKET, AND METHOD FOR COVERING CHAIR OCCUPANT

BACKGROUND OF THE INVENTION

1. Field of the Invention

The present invention relates to blankets. More specifically, the invention pertains to a covering to provide warmth to an occupant in a chair such as a wheelchair. In addition, the present invention relates to a method for covering a wheelchair occupant.

2. Description of the Related Art

It is sometimes difficult for an occupant in a chair to stay warm. There are several reasons for this. First, merely placing a blanket over the occupant does not protect the underside and back of the occupant from the elements. Second, in the case of a wheelchair occupant, the occupant may be limited in movement, resulting in a reduced degree of warmth that would otherwise be received from increased blood circulation. Finally, it is sometimes difficult for the wheelchair occupant to keep a blanket comfortably around them during transportation. In this respect, the blanket may fall or the fringes of the blanket may become entwined in the spokes of the wheelchair.

Various garment-type items have been proposed for keeping an occupant in a chair such as a wheelchair warm. For example, U.S. Pat. No. 4,363,141 teaches a quilt for use with wheelchairs. The quilt has a pouch for the feet that extends partially up the legs. The quilt includes a drawstring for tightening the pouch about the knees. However, the quilt provides only limited coverage for the underside of the wheelchair occupant. U.S. Pat. Nos. 4,651,346, 4,932,077, 5,604,932 and 5,970,542, which teach various configurations of lap blankets or "foot pouch" blankets, suffer from the same limitations, though some are not necessarily limited to wheelchair applications.

U.S. Pat. Nos. 2,716,239 and 6,643,870 disclose unitary body garments intended to be wrapped about a patient's body. These arrangements may prevent adequate use of a wheelchair occupant's arms.

Finally, U.S. Pat. No. 4,534,065 discloses a blanket for wrapping about one's legs while seated in a chair. The blanket is four-sided, but may be wrapped into a tube for receiving an individual. Folds are made in the blanket in order to align edges of the blanket with Velro™ strips. Making these folds may be difficult for a wheelchair occupant, although the patent does not actually show or mention a wheelchair.

Despite the benefits offered by the above inventions, there remains a need for a blanket that provides additional warmth to a chair occupant. Further, a need remains for a method of covering an occupant in a chair such as a wheelchair.

SUMMARY OF THE INVENTION

A blanket for a chair occupant is provided. The blanket has an upper end, a lower end, opposing sides, an outer surface to be placed onto the seat and back of the chair, an inner surface on which the occupant sits, and a connector for connecting the opposing sides over the occupant when the occupant is seated onto the inner surface of the blanket. The connector may be a zipper or a hook-and-loop attachment or other means. Preferably, the upper and lower ends of the blanket have drawstrings. In one aspect, a hook and loop attachment is provided for selectively connecting an end of the lower draw string to the blanket.

In one aspect, the blanket includes an attachment mechanism for releasably attaching the blanket to the chair. The attachment mechanism may be part of a flap along the upper end of the blanket, or perhaps a pair of loops. The attachment mechanism serves to maintain the blanket in position while the occupant is being seated onto the blanket and the wheelchair. In another arrangement, the blanket includes a foot pouch for receiving the feet of the chair occupant. The foot pouch has left and right compartments, and may include at least one rigid member configured to rest on a foot rest of a wheelchair. The foot pouch may be detachable.

A method for covering an occupant in a chair is also provided. The chair has a seat and a back. In one embodiment, the method includes the steps of providing a blanket as described above, placing the blanket over the seat of the chair, seating the occupant onto the blanket in the chair, folding the opposing sides of the blanket over the occupant, and connecting the opposing sides using the connector.

The method may include securing a flap on the upper end of the blanket to the back of the chair. In this way the position of the blanket is secured relative to the wheelchair while the occupant is being seated onto the blanket and the wheelchair. The method may alternately include the step of zipping up the foot pouch between the left and right compartments to provide additional warmth to the occupant's feet.

BRIEF DESCRIPTION OF THE DRAWINGS

So that the manner in which the above recited features of the present invention can be better understood, certain drawings are appended hereto. It is to be noted, however, that the appended drawings illustrate only selected embodiments of the inventions and are therefore not to be considered limiting of scope, for the inventions may admit to other equally effective embodiments and applications.

DETAILED DESCRIPTION

Definitions

As used herein, the term "occupant" refers to any person of any age or size.

The term "chair" refers to any chair having a seat and a back, including for example a wheelchair. The term "wheelchair" refers to any configuration of ambulatory chair.

Description of Specific Embodiments

Figure 1:
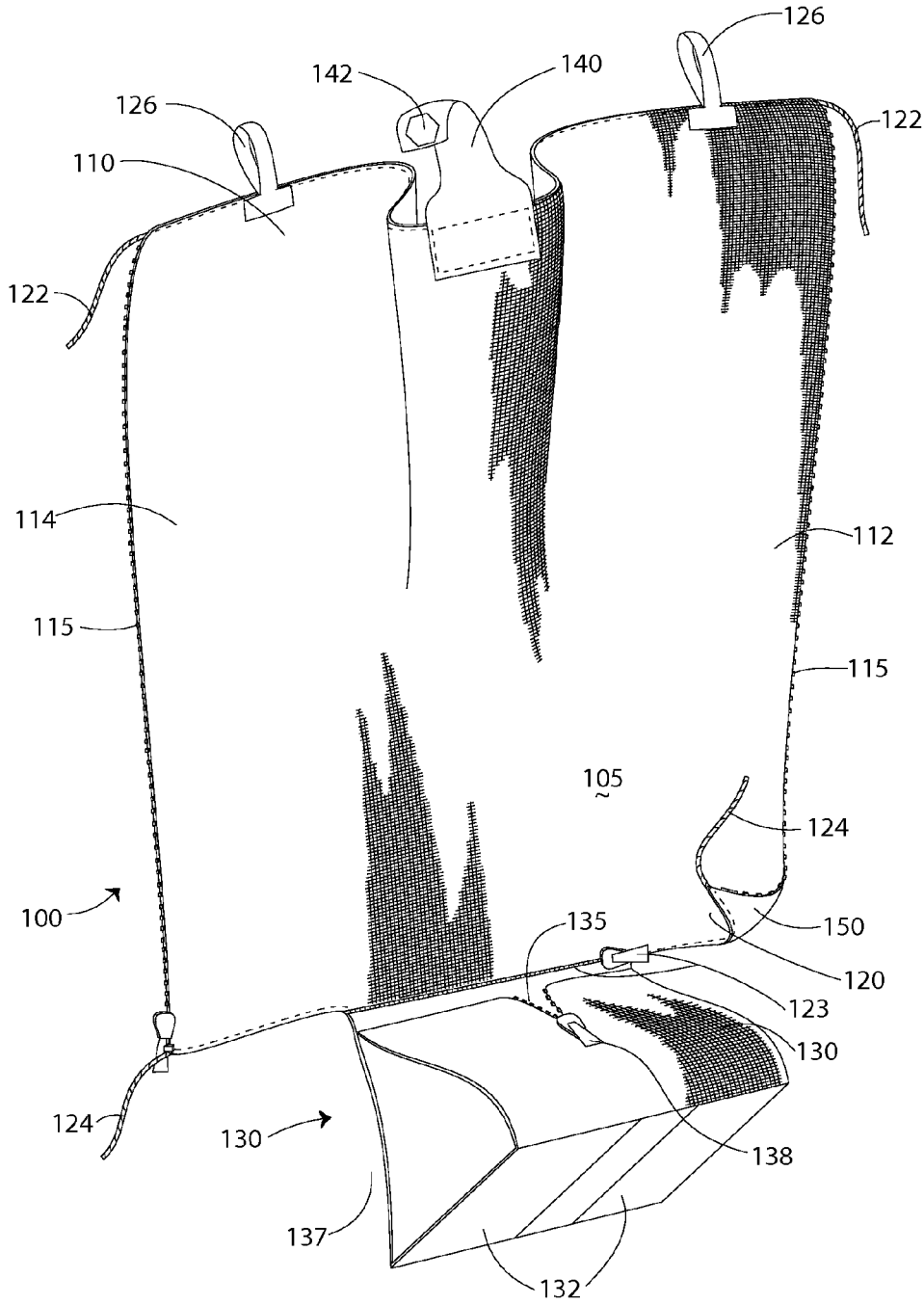
FIG. 1 presents a perspective view of a blanket of the present invention, in one embodiment. The inner surface of the blanket is primarily seen.

FIG. 1 presents a perspective view of a blanket 100 of the present invention, in one embodiment. The blanket 100 preferably has four sides, including an upper end 110, a lower end 120, and opposing sides 112, 114. It is also preferred that the upper end 110 have a width that is greater than the width of the lower end 120. Together the upper 110 and lower 120 ends may illustratively form an inverted frusto-conical profile, a volcanic profile, or other form.

The blanket 100 further includes an inner surface 105 and an outer surface 120. Preferably, the inner surface 105 is fabricated from a soft but fire resistant material such as Protek™ manufactured by Pellon. Preferably, the outer surface 120 is a separate item of material that is fabricated from a water-repellant material. In this way, the two surfaces 105, 120 define separate items of fabric that are "quilted" together. However, it is within the scope of the present invention for the two surfaces to be opposite surfaces of the same item of material or fabric.

The blanket 100 is designed with a chair occupant in mind. In this respect, the outer surface 120 of the blanket 100 would engage the seat of a chair, while the inner surface 105 would envelope the occupant while the occupant is seated. To facilitate this use of the blanket 100, a connector 115 is provided along the opposing sides 112, 114. In one aspect, the connector 115 is a zipper. The zipper 115 is used for connecting the opposing sides 112, 114 of the blanket 100 over the occupant after the occupant has been seated into the chair and onto the blanket 100.

Figure 4:
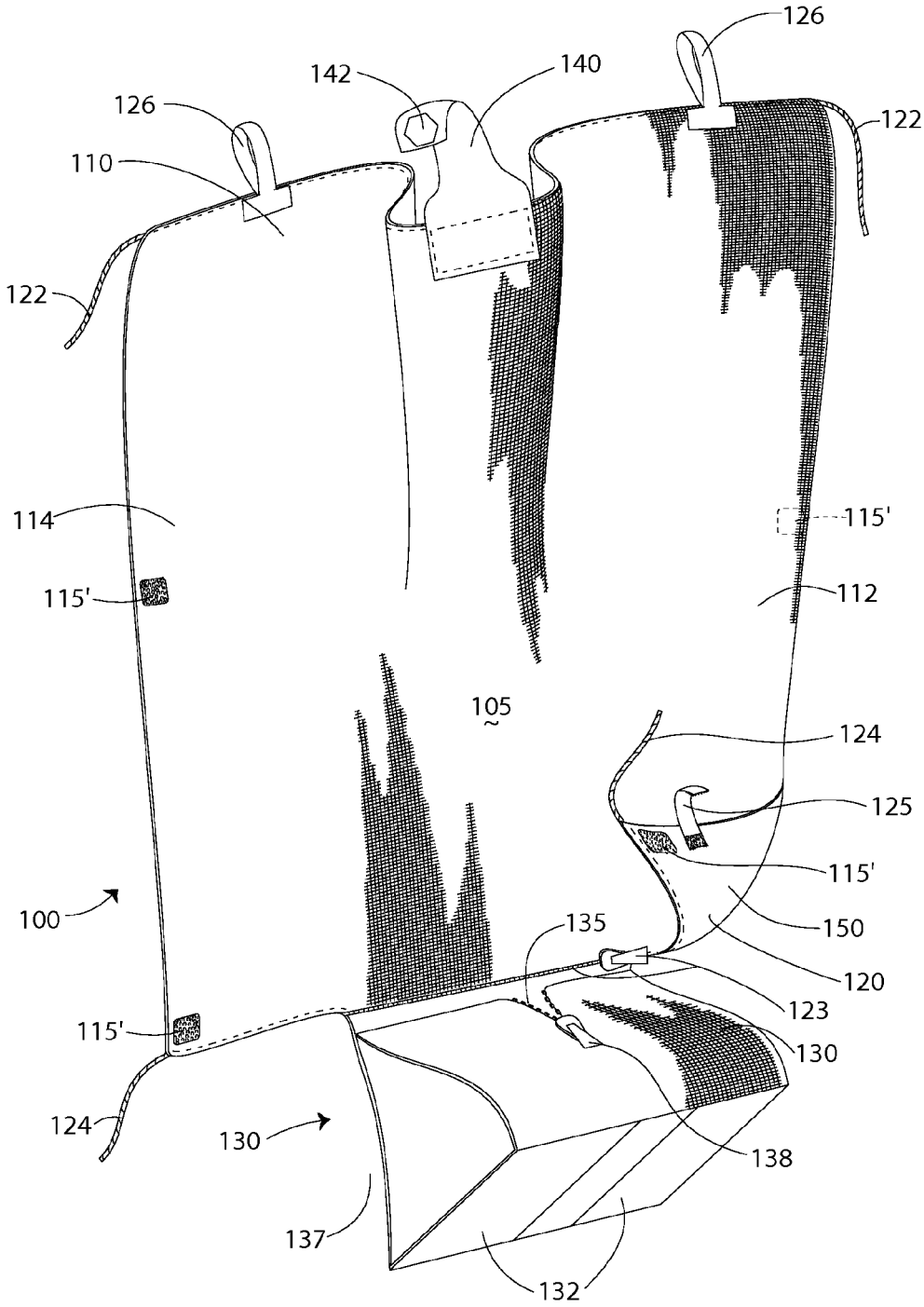
FIG. 4 is a perspective view of the blanket of the present invention, in an alternate embodiment. Here, the connector for connecting the opposing sides of the blanket comprises a hook-and-loop attachment.

Alternative means for the connector 115 may be employed. FIG. 4 is a perspective view of the blanket 100 of the present invention, in an alternate embodiment. Here, the connector for connecting the opposing sides 112, 114 of the blanket 100 comprises at least one hook-and-loop attachment 115', such as Velcro™.

Additional, optional features of the blanket 100 are also presented in FIG. 1. First, a foot pouch 130 may be fabricated into the lower end 120 of the blanket 100. The foot pouch 130 defines a central opening 135 configured to receive the feet (not shown) of the occupant. Preferably, the foot pouch 130 includes a left compartment 136, a right compartment 137, and a rigid member 132 in the bottom to help define and access the compartments 136, 137. In FIG. 1, the rigid member 132 is shown integral to the pouch 130. Further, the rigid member 132 is shown configured as separate left and right members that correspond to left and right foot rests (seen at 230 in FIG. 2) in a wheelchair. However, the rigid member 132 may be a single item of material. An example of a suitable rigid material is a product called Stitch in Shape™. The material Stitch in Shape™ may be washed or wetted and then shaped as it dries. The material will retain its shape in a substantially rigid fashion so that it may conform to a desired profile. In this embodiment, the material forming the rigid member 132 would also be sewn into the foot pouch 130, and then shaped to conform to the angle of the foot rests 230 of a wheelchair.

It is understood that the rigid member 132 may alternatively be an item of plastic or other durable and light weight material that is separate and removable from the foot pouch 130. In either embodiment, the rigid member 132 will typically have a footprint that is larger than the foot rests 230 of a wheelchair so as to accommodate the feet of the occupant if seated in a wheelchair.

The blanket 100 preferably also includes a zipper for connecting the left 136 and right 137 compartments in the foot pouch 130. An exemplary zipper is shown at 138 in FIG. 1. As can be seen, the zipper 138 helps to at least partially enclose the foot pouch 130 so as to keep the occupant's feet warmer. In one aspect (not shown), the zipper connects to the inner surface 105 of the blanket within the foot pouch 130. Preferably, however, the zipper 138 simply closes the opening 135. With the ends already enclosed by fabric, the foot pouch 130 can keep a user's feet warm in cold weather.

In one optional aspect, the foot pouch 130 is detachable. A detachment means in the form of a zipper, a hook-and-loop attachment, snaps, or other means may be employed. In the arrangement of FIG. 1, a zipper 123 is demonstrated. The zipper 123 is "zipped up" to attach the foot pouch 130 to the lower end 120 of the blanket 100. Unzipping" the zipper 123 allows the foot pouch 130 to be detached when the weather is not sufficiently cold to warrant use of the foot pouch 130.

Also shown in FIG. 1 are optional attachment devices 140, 126. The attachment devices 140, 126 serve to provide a releasable attachment between the upper end 110 of the blanket 100 and the chair 200. 140. The blanket 100 preferably would include both attachment devices 140, 126 but may optionally include one or the other.

Referring to the first attachment device 140, this device comprises a flap. The flap 140 defines an elongated piece of material that extends out from the upper end 110 of the blanket 100. Preferably, the flap 140 is fabricated from leather or synthetic leather. In one aspect, the flap 140 is sewn into the inner surface 105 of the blanket 100. The flap 140 includes an attachment member 142, such as Velcro™. The attachment member 142 connects to an attachment member 144 on a chair (seen at 200 in FIG. 2).

The second attachment device 126 defines a pair of loops 126. The loops 126 are quilted into the upper end 110 of the blanket, and are spaced apart to conform to the geometry of handle bars 222 of a wheelchair (seen at 200 in FIG. 2). In use, the handle bars 222 of the wheelchair 200 are received into the loops 126 to secure the position of the blanket 100 relative to the wheelchair 200. Preferably, each loop 126 is also fabricated from leather or synthetic leather.

In one embodiment, the blanket 100 includes upper 122 and lower 124 draw strings. The draw strings 122, 124 allow the occupant (or his or her caretaker) to pull the upper 110 or lower 120 ends of the blanket 100 around the occupant for warmth.

Figure 2:
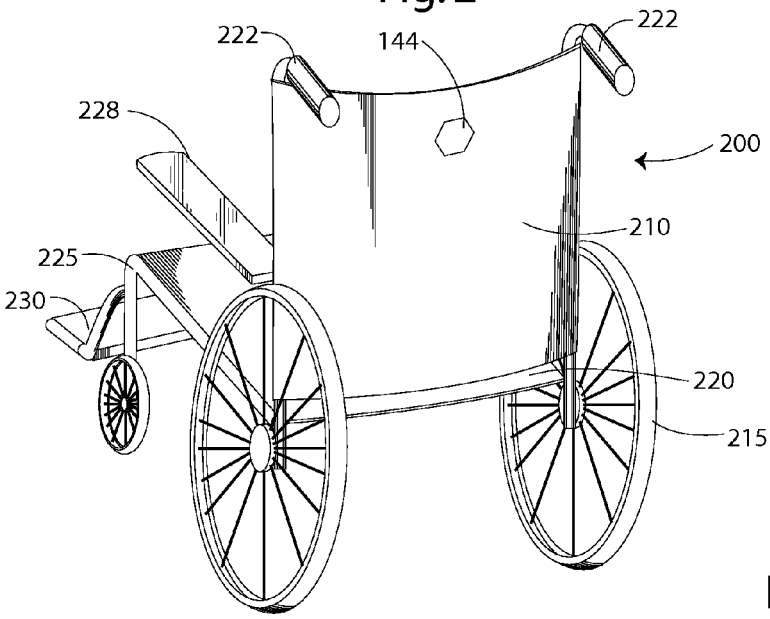
FIG. 2 shows a perspective view of an exemplary wheelchair for receiving the blanket of FIG. 1. The upper, rear portion of the wheelchair is shown.

FIG. 2 shows a perspective view of an illustrative chair 200 for receiving the blanket 100 of FIG. 1. The illustrative chair 200 is a wheelchair. However, it is understood that any chair may be used by an occupant. The upper, rear portion of the wheelchair 200 is shown. Specifically, the back of the back rest 210 is demonstrated. An attachment member 144 is placed on the back of the back rest 210. The attachment member 144 is used to receive the attachment member 142 of the flap 140. It is understood that the attachment member 144 may be placed on the front side of the back rest 210.

Figure 3:
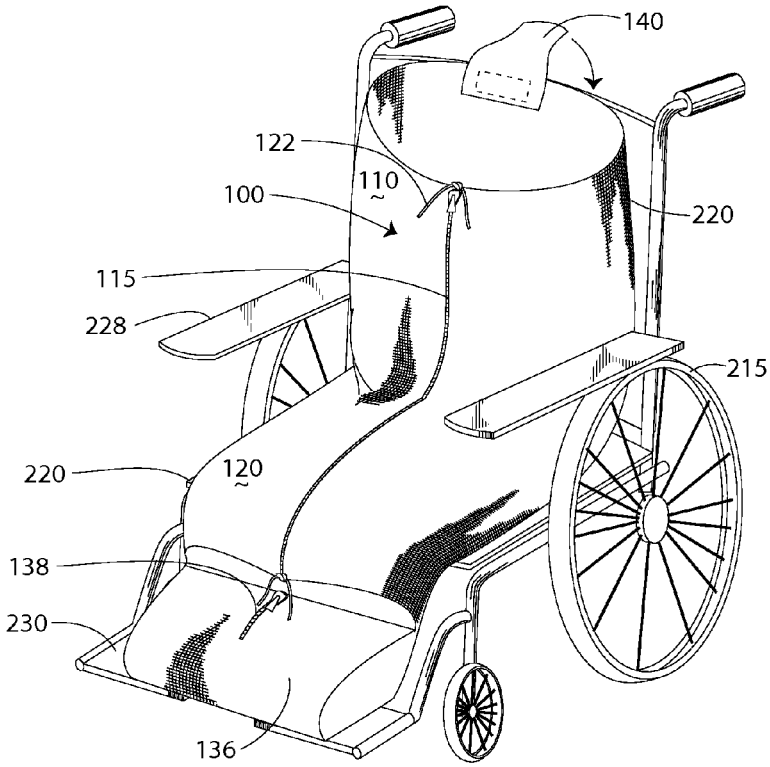
FIG. 3 shows the blanket of FIG. 1 laid onto the seat of a wheelchair. The flap of the upper end of the blanket is being attached to a back of the wheelchair.

FIG. 3 shows the blanket of FIG. 1 laid onto the seat of a wheelchair. The flap 140 of the upper end of the blanket is in position to be attached to the back of the wheelchair 200. In addition, the sides 112, 114 have been folded over so as to more fully show the back surface 150 of the blanket 100. The side zipper 115 has been connected or "zipped up." It is understood that, in practice, an individual will sit on the inner surface 105 of the blanket 100 before the sides 112, 114 are connected.

Optionally, a hook and loop attachment (not shown) may be provided on the outer surface 150 of the blanket 100. The hook and loop attachment provides a means by which the ends of the lower drawstring 122 may be secured in a more accessible place after the drawstring 122 has been tied.

A method for covering an occupant in a chair is also provided herein. In one embodiment, the method employs the blanket 100 of FIG. 1. In this respect, a blanket is provided wherein the blanket has an upper end 110, a lower end 120 and opposing sides 112, 114. The blanket 100 also includes the connector 115 for connecting the opposing sides 112, 114 over the occupant when the occupant is seated onto the blanket 100. The blanket 100 may also include the foot pouch 130.

The blanket 100 is placed such that the outer surface 150 is laid over the seat 220 of a chair 200. Where a flap 140 is employed, the attachment member 142 of the flap 140 is connected to the attachment member 144 of the wheelchair 200. This allows the blanket 100 to be maintained in a spread condition as the occupant is seated into the wheelchair 200.

Next, the occupant sits in the seat portion 220 of the wheelchair 200. More specifically, the occupant engages the inner surface 105 of the blanket 100 on the seat 220. The occupant (or his or her caretaker or assistant) will then fold the opposing sides 112, 114 of the blanket 100 over the occupant for warmth. The connector 115 is then applied to secure the opposing sides 112, 114 together. Where the connector 115 is a zipper, the connector is "zipped up."

Additional steps may optionally be employed. Where the blanket 100 includes the foot pouch 130, the occupant's feet are placed within the pouch 130. Where the blanket 100 includes a draw string, such as upper draw string 122 or lower draw string 124, the draw string is tied to provide further warmth for the occupant. Where a hook and loop attachment is provided on the outer surface of the blanket 100, the lower draw string 124 is secured to the outer surface of the blanket 100.

In one aspect, the method may include the step of providing a foot pouch at a lower end of the blanket such that the foot pouch has a lower foot rest portion 132. The foot rest portion 132 is fabricated from a material that may be manipulated into a fixed shape when it is damp. The foot pouch 130, or at least the foot rest portion 132, is washed. Thereafter, the lower foot rest portion 132 is formed into a substantially planar shape. The foot rest portion is then placed onto the foot pads 230 of the wheelchair 200. Where the zipper 138 is provided for the foot pouch 130, the zipper 138 would be zipped up.

I claim:

1. A blanket for a wheelchair occupant, the wheelchair having a seat and a back, and the blanket comprising:
- an upper end having a first length;
- a lower end having a second shorter length, thereby forming a frusto-conical profile in the blanket;
- opposing sides;
- an outer surface to be placed onto the seat and back of the wheelchair;
- an inner surface on which the occupant sits;
- a connector for connecting the opposing sides over the occupant when the occupant is seated onto the inner surface of the blanket;
- an attachment device along the upper end of the blanket for releasably attaching the blanket to the wheelchair, the attachment device comprising a flap along the upper end of the blanket, the flap being configured to releasably connect to the wheelchair;
- a foot pouch for receiving the feet of the occupant;
- at least one rigid member configured to rest on a foot rest of a wheelchair, the at least one rigid member being fabricated from a material that may be shaped as it dries after being washed following use;
- an upper drawstring along the width of the upper end;
- a lower drawstring along the width of the lower end; and
- a hook and loop attachment for selectively connecting an end of the lower draw string to the blanket.

2. The blanket of claim 1, wherein the flap connects to a back surface of the wheelchair.

3. The blanket of claim 1, wherein the connector defines at least one hook-and-loop attachment.

4. The blanket of claim 1, wherein the connector defines a zipper.

5. The blanket of claim 1, wherein the foot pouch is removable from the lower end of the blanket.

6. The blanket of claim 5, wherein the foot pouch comprises:
- left and right foot compartments; and
- a zipper connector for connecting the left and right compartments.

7. A method for covering an occupant in a wheelchair, the wheelchair having a seat and a back, comprising the steps of:
- providing a blanket comprising:
  - an upper end having a first length,
  - a lower end having a second shorter length, thereby forming a frusto-conical profile in the blanket,
  - opposing sides,
  - an outer surface to be placed onto the seat and back of the chair,
  - an inner surface on which the occupant sits,
  - a connector for connecting the opposing sides over the occupant when the occupant is seated onto the inner surface of the blanket,
  - an attachment device along the upper end of the blanket for releasably attaching the blanket to the wheelchair, the attachment device comprising a flap configured to releasably connect to a back of the wheelchair,
  - a lower drawstring along the width of the lower end,
  - a hook and loop attachment for selectively connecting an end of the lower draw string to the blanket, and
  - a foot pouch at a lower end of the blanket, the foot pouch having left and right foot compartments for receiving the feet of the occupant and a lower foot rest portion that is fabricated from a material that may be manipulated into a fixed shape as it dries;
- placing the blanket over the seat of the wheelchair;
- connecting the flap to the wheelchair;
- seating the occupant onto the blanket in the wheelchair;
- folding the opposing sides of the blanket over the occupant;
- connecting the opposing sides using the connector;
- securing the end of the lower drawstring to the blanket by means of the hook and loop attachment;
- washing at least the foot rest portion of the pouch;
- forming the lower foot rest portion into a substantially planar shape; and
- placing the foot rest portion onto foot pads of the wheelchair after it has substantially dried from being wetted.

8. The method of claim 7, wherein the flap connects to a back surface of the wheelchair.

9. The method of claim 7, wherein the connector defines at least one hook-and-loop attachment.

10. The method of claim 7, wherein the connector defines a zipper.

11. The method of claim 7, wherein the blanket is at least partially fabricated from a synthetic material.

12. The method of claim 7, wherein the foot pouch is detachable.

13. A blanket for a wheelchair occupant, the wheelchair having a seat and a back, and the blanket comprising:
- an upper end having a first length;
- a lower end having a second shorter length, thereby forming a frusto-conical profile in the blanket;
- opposing sides;
- an outer surface to be placed onto the seat and back of the wheelchair;
- an inner surface on which the occupant sits;
- a connector for connecting the opposing sides over the occupant when the occupant is seated onto the inner surface of the blanket;
- an attachment device along the upper end of the blanket for releasably attaching the blanket to the wheelchair, the attachment device comprising a flap along the upper end of the blanket, the flap being configured to releasably connect to the wheelchair;

a foot pouch for receiving the feet of the occupant, the foot pouch comprising left and right foot compartments for receiving the feet of the occupant, and a zipper connector for connecting the left and right compartments, wherein the foot pouch is removable from the lower end of the blanket; and at least one rigid member configured to rest on a foot rest of a wheelchair, the at least one rigid member being fabricated from a material that may be shaped as it dries after being washed following use.

14. The blanket of claim 13, wherein the flap connects to a back surface of the wheelchair.

15. The blanket of claim 13, wherein the connector defines at least one hook-and-loop attachment.

16. The blanket of claim 13, wherein the connector defines a zipper.

17. The blanket of claim 13, further comprising:

an upper drawstring along the width of the upper end.

18. The blanket of claim 13, further comprising:

a lower drawstring along the width of the lower end; and a hook and loop attachment for selectively connecting an end of the lower draw string to the blanket.

* * * * *